US006763876B1

(12) United States Patent
Donahue et al.

(10) Patent No.: US 6,763,876 B1
(45) Date of Patent: Jul. 20, 2004

(54) METHOD AND APPARATUS FOR CASTING OF METAL ARTICLES USING EXTERNAL PRESSURE

(75) Inventors: Raymond J. Donahue, Fond du Lac, WI (US); Terrance M. Cleary, Fond du Lac, WI (US); Parker A. Stroom, Birmingham, AL (US)

(73) Assignee: Brunswick Corporation, Fond du Lac, WI (US)

( * ) Notice: Subject to any disclaimer, the term of this patent is extended or adjusted under 35 U.S.C. 154(b) by 0 days.

(21) Appl. No.: 10/228,935

(22) Filed: Aug. 27, 2002

Related U.S. Application Data

(63) Continuation-in-part of application No. 09/843,184, filed on Apr. 26, 2001, now abandoned.

(51) Int. Cl.[7] ..... B22C 9/04
(52) U.S. Cl. ..... 164/34; 164/258
(58) Field of Search ..... 164/256, 257, 164/258, 34, 35

(56) References Cited

U.S. PATENT DOCUMENTS

| | | | | |
|---|---|---|---|---|
| 4,139,045 A | * | 2/1979 | Vitt | 164/34 |
| 4,240,493 A | | 12/1980 | Wilmarth | 164/35 |
| 4,300,617 A | | 11/1981 | Bauer | 164/244 |
| 4,854,368 A | | 8/1989 | Vezirian | 164/34 |
| 5,014,764 A | | 5/1991 | Garat | 164/34 |
| 5,058,653 A | | 10/1991 | Garat | 164/34 |
| 5,088,544 A | | 2/1992 | Garat | 164/34 |
| 5,161,595 A | | 11/1992 | Garat | 164/34 |
| 5,335,711 A | | 8/1994 | Paine | 164/66.1 |
| 5,941,297 A | | 8/1999 | Young | 164/62 |
| 5,954,113 A | | 9/1999 | Buchborn | 164/61 |

OTHER PUBLICATIONS

Web Site.www.eng.uab.edu mte about research xray. UAB Casting Engineering Laboratory, Feb. , 2002.

* cited by examiner

*Primary Examiner*—Kiley Stoner
*Assistant Examiner*—Len Tran
(74) *Attorney, Agent, or Firm*—Andrus, Sceales, Starke & Sawall LLC

(57) ABSTRACT

A method for casting of metal articles using external pressure and having particular application to lost foam casting of metal articles. A polymeric foam pattern having a configuration corresponding to an article to be cast is placed in an outer flask and the pattern is connected through a polymeric foam gating system to a pouring cup located at the upper end of the flask. The pouring cup has a volume equal to 5% to 75% of the combined volume of the gating system and the pattern. A finely divided inert material, such as sand, is placed in the flask surrounding the pattern and fills the internal cavities within the pattern. The flask containing the pattern is then positioned in an outer pressure vessel having a removable lid and a molten metal is fed into the pouring cup. The lid on the pressure vessel is closed and an external gaseous pressure is applied to the molten metal in the pouring cup as the molten metal feeds through the gating system to the pattern and progressively decomposes the polymeric foam material. The gaseous products of decomposition passing into the interstices of the sand and the molten metal filling the void created by decomposition of the foam. By applying pressure to the molten metal during filling, the molten metal front is more stable and fewer casting defects arise.

7 Claims, 1 Drawing Sheet

METHOD AND APPARATUS FOR CASTING OF METAL ARTICLES USING EXTERNAL PRESSURE

CROSS REFERENCE TO RELATED APPLICATIONS

This application is a continuation-in-part of U.S. patent application Ser. No. 09/843,184, filed Apr. 26,2001 now abandoned.

BACKGROUND OF THE INVENTION

The present invention relates to a method and apparatus for the casting of metal articles using external pressure.

In lost foam or evaporable foam casting, a pattern is produced from a polymeric foam material, such as polystyrene, and has a configuration identical to the metal article to be cast. A porous ceramic coating is applied to the outer surface of the pattern. One or more patterns are located within an outer mold or flask and a polymeric foam gating system connects each pattern to a sprue. The space between the patterns and the flask is then filled with a finely divided inert material, such as sand, and the sand also fills the internal cavities within the pattern.

In the casting process, the molten metal is fed into the sprue and the heat of the molten metal will act to decompose the polymeric foam material of the gating system, as well as the pattern, with the molten metal then occupying the void created by ablation of the foam material, with the decomposition products of the foam passing through the porous ceramic coating on the pattern and being trapped within the interstices of the sand. On solidification of the molten metal, the resulting cast article has a configuration identical to the polymeric foam pattern.

It is recognized that the application of external pressure to the molten metal before solidification of the metal is completed can aid in the interdendritic feeding of the casting and prevent both the precipitation of hydrogen porosity and the formation of microporosity. For example, U.S. Pat. Nos. 4,854,368, 5,014,764, 5,058,653, 5,088,544 and 5,161,595 describe processes of lost foam casting utilizing external pressure. The aforementioned patents state that the polymeric foam pattern is placed in an outer pressure vessel having a hinged lid and sand is fed into the pressure vessel surrounding the pattern, as well as the gating system. The molten metal is fed into the sprue and the heat of the molten metal will slowly ablate the polymeric foam gating system and the pattern. After the casting is completely filled, and before the molten metal has solidified, the lid on the pressure vessel is closed and pressure is applied to the molten metal, as well as to the upper surface of the sand.

However, it has been found that the method as described in the aforementioned patents has certain drawbacks. The large pressure gradient that occurs on the sudden application of pressure can cause metal penetration defects. The molten metal front is relatively unstable and the gaseous foam decomposition products tend to push back the metal front causing instability. Furthermore, the gas resulting from the foam decomposition often becomes trapped in the molten metal when pushing back, causing microporosity defects.

Another drawback of the methods described in the aforementioned patents is the appearance of "folds". A "fold" is a defect that occurs on filling of the mold when the products of the foam decomposition become trapped between the molten metal fronts. Such folds appear at the casting surface. The molten metal front pushes both gas and liquid decomposition products resulting from the foam pattern decomposition to the porous ceramic coating interface. The gaseous by-products of the foam pattern decomposition escape through the porous ceramic coating, and, under perfect conditions, it is contemplated that the heat from the molten metal will eventually evaporate the liquid by-products into gaseous form. However, when the liquid decomposition products become trapped between metal fronts, such liquid by-products never reach the coating. As the liquid fails to reach the coating, it is unable to escape through evaporation. The liquid becomes trapped, and results in the creation of folds in the casting surface. The folds are undesirable as they create weak sections in the surface and also can create porosity in the surface.

Further, the casting system as described in the above patents requires that each flask be a pressure vessel, and in commercial production this is a serious economic drawback. For example, when casting large engine blocks for internal combustion engines, the pressure vessel which serves as the flask must necessarily have substantial size and bulk. The cost of producing a pressure vessel of this size is quite substantial, and in commercial production where castings are made on a continuous basis, the overall cost of the quantity of pressure vessels required for production casting can make the system economically prohibitive.

SUMMARY OF THE INVENTION

The invention is directed to an improved method of casting utilizing external pressure and has particular application to lost foam casting. In accordance with a method of the invention, a generally cylindrical, metal flask or mold is placed within a pressure vessel having a removable lid. Located within the flask is one or more ceramic coated patterns formed of a polymeric foam material, such as polystyrene, and the patterns are connected through a gating system to a sprue located at the upper end of the flask.

A finely divided, unbonded, inert material, such as sand, surrounds the patterns and the gating in the flask and fills the internal cavities in the pattern. Located in the upper end of the pressure vessel is a pouring cup which communicates with the sprue, and the pouring cup has a relatively large volume, with the volume of the cup being at least 15% of the combined volume of the pattern and gating.

In the casting procedure, with the lid of the pressure vessel in the open or removed condition, a molten metal, which can take the form of an aluminum alloy, steel, or other alloy, is fed into the pouring cup. The heat of the molten metal will progressively decompose the polymeric foam material of the gating, with the gaseous products of decomposition passing through the porous ceramic coating on the foam and being trapped in the interstices of the sand. As the molten metal front progressively passes through the gating, it will come into contact with the pattern, and similarly, the foam material of the pattern will be decomposed by the heat of the molten metal, with the gaseous products of decomposition passing through the porous coating on the pattern and being trapped in the interstices of the sand.

In accordance with the invention, after the pouring cup is filled with the molten metal and before the molten metal front has decomposed the pattern, the lid on the pressure vessel is closed and sealed, and an external pressure, preferably in the amount of 5 to 50 atmospheres is applied to the molten metal in the cup, as well as to the upper surface of the sand in the flask. The pressure is maintained until the molten metal solidifies into the final cast article.

With the invention, the large volume pouring cup supplies the molten metal needs of the casting after the lid is closed, and thus pressure is applied before the molten metal filling of the casting is complete. This permits the early gentle application of pressure to avoid sand penetration defects that have occurred in prior casting methods. By maintaining pressure on the molten metal during filling, the molten metal front is more stable and the liquid and gaseous products of foam decomposition are less likely to push back the molten metal front and become trapped in the metal. Instead, the by-products of foam decomposition are pushed under pressure to the permeable coating on the pattern and can exit and subsequently condense in the sand grains.

When dealing with aluminum silicon alloys, the maintenance of pressure on the molten metal during filling stabilizes the molten metal front and decreases the presence of folds in the casting surface. If pressure is not maintained during filling, it is reasonable to expect the metal front to become unstable. If the metal front grows unstable, the instabilities appear as separate "fingers" in the molten metal front. This "fingering" of the molten metal front has been observed through real-time x-ray viewing of the lost foam filling event and is documented by the U.S. Department of Energy Lost Foam Consortium under the direction of Dr. Charles Bates, Ph.D. http://www.eng.UAB.edu/mte/about/research/xray, (June, 2002). As the instability grows, the fingers grow and encounter their neighbors, entrapping liquid from the decomposition of the pattern between the fingers. When the fingers reach the porous ceramic coating, they trap the liquid within the metal, preventing the liquid from coming into contact with the coating, further preventing the liquid from evaporating, and ultimately creating folds in the casting surface.

With the invention, pressure is applied before filling is complete. The pressure stabilizes the metal front well inside the coating boundaries and prevents the "fingering" effect as the metal front moves through the pattern. Thus, applying pressure before filling is complete attacks the fold defect problem by creating a more stable front. Furthermore, the application of pressure during filling facilitates the creation of polymeric decomposition gasses, creates a smaller gas gap between the molten metal front and the liquid decomposition products, and results in a quicker exit of gaseous decomposition products through the coating. Only this constant pressure application during filling, and not the application of pressure after filling, can assist in facilitating the elimination of such foam related defects.

A further advantage of the invention is that the pressure vessel, which is an expensive structure, is not used as the mold or flask, but instead an inexpensive lightweight flask is used inside of the pressure vessel. This is of particular advantage in the commercial production, particularly of large cast objects, such as engine blocks, where a pressure vessel must be of considerable size and bulk to house the cast engine block.

Further, the cylindrical shape of the flask enables vertical compaction of the sand to be used and this minimizes sand compaction faults.

Other features, objects and advantages will appear in the course following description.

DESCRIPTION OF THE DRAWINGS

The drawing illustrates the best mode presently contemplated of carrying out the invention.

In the drawing.

DESCRIPTION OF THE PREFERRED EMBODIMENT

Figure 1:
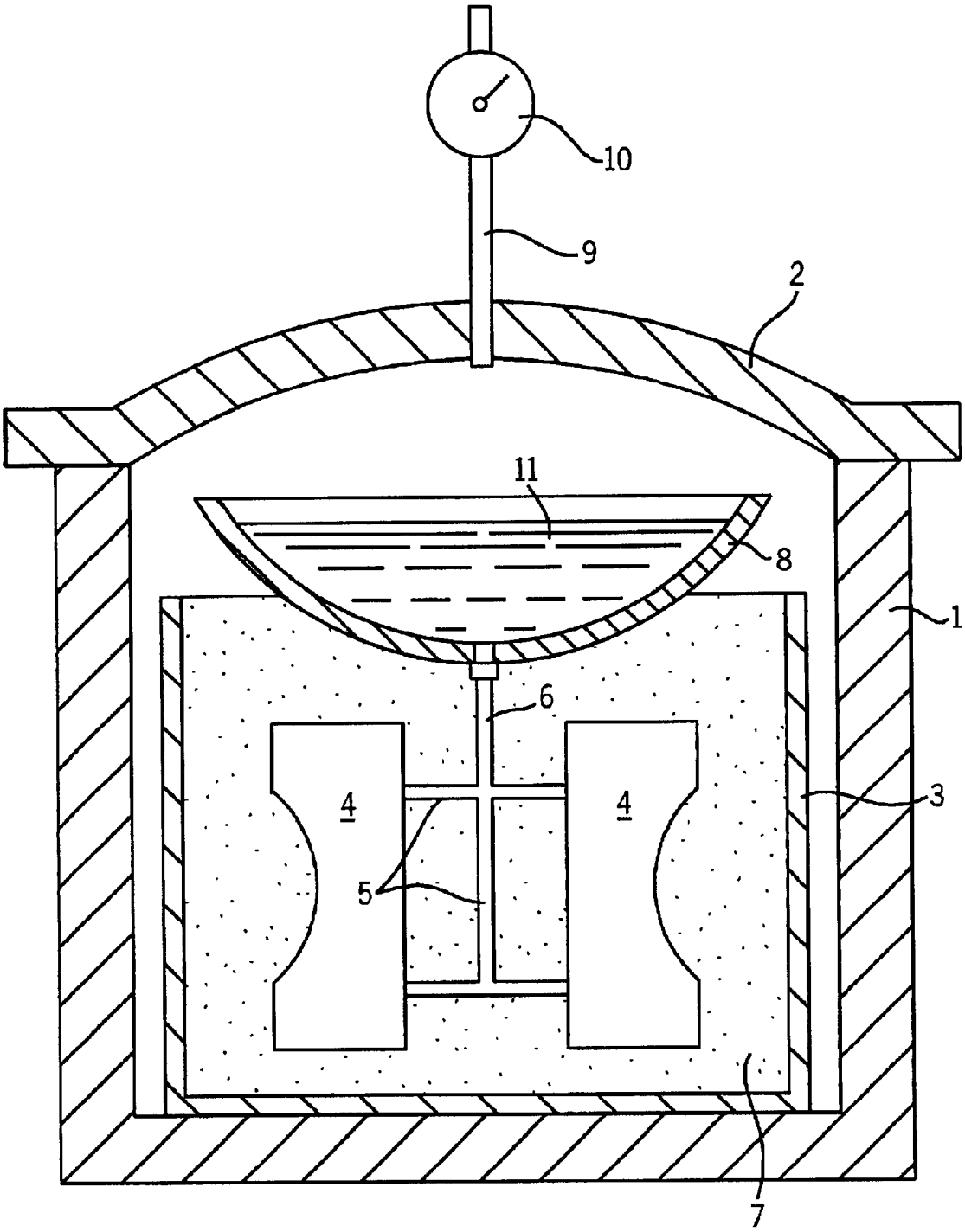
FIG. 1 is a vertical section of an apparatus that can be used to carry out the method of the invention

The drawing illustrates an apparatus that can be used in carrying out the casting method of the invention The apparatus includes a pressure vessel 1 having an open end which is enclosed by a lid 2. In practice, the lid may be hinged to the pressure vessel and moved between an open and a closed sealed condition by mechanical equipment, not shown. When casting relatively large objects, such as engine blocks for internal combustion engines, the pressure vessel can be of substantial size, as for example, about thirty-six inches in diameter and forty-two inches high.

In the casting process, a metal, generally cylindrical, open top mold or flask 3 is positioned in pressure vessel 1 and one or more patterns 4 formed of a polymeric foam material, such as polystyrene, are located in the flask 3. Each pattern 4 has an outer porous ceramic coating and has a configuration corresponding to the article to be cast. Patterns 4 are connected through gating 5 to sprue 6. The gating 5 and sprue 6 are also formed of the polymeric foam material.

Surrounding the patterns 4 and gating 5 in flask 3 is a finely divided inert material 7, such as silica sand or fused mullite. The sand 7 also fills the voids or cavities in the patterns 4.

As a feature of the invention, a large volume pouring cup 8, preferably formed of a ceramic fiber material, is located at the upper end of flask 3 and communicates with sprue 6. Pouring cup 8 has a volume equal to at least 15% of the combined volume of patterns 4 and gating 5, and preferably in the range of 25% to 75% of the combined volume.

A pressure line 9 is mounted within an opening in lid 2 and connects a suitable source of compressed air or an inert gas, such as nitrogen and argon, with the interior of pressure vessel 1. Pressure gauge 10 can be mounted in line 9. Alternately, pressure line 9 can be connected through the side wall of pressure vessel 1.

In carrying out the process, the patterns 4 and gating 5 are initially mounted in flask 3 and the sand 7 is then introduced into the flask to surround the patterns and the gating, as well as to fill the cavities or voids in the pattern. The sand is then compacted by conventional methods using vertical compaction.

With lid 2 in the open position and pouring cup 8 connected to sprue 6, a molten metal, which can take the form of an aluminum silicon alloy, a magnesium alloy, stainless steel, or the like, is then poured into the pouring cup 8 and the lid 2 is then immediately moved to the closed and sealed position. Pressure, preferably in the range of 5 to 50 atmospheres, is then applied to the molten metal 11 in the cup through pressure line 9. The pressure is also applied to the upper surface of sand 7. The pressure is applied rapidly or can be applied gradually in increments to achieve the above-mentioned pressure conditions.

The molten metal poured into cup 8 is generally at a temperature greater than 1250° F. and the heat of the molten metal will melt, vaporize and decompose in various fractions the polymeric sprue 6 and gating 5, with the resulting gaseous products of decomposition passing through the porous ceramic coating on the sprue and gating and into the interstices of the sand 7. The molten metal will thus occupy the void created by vaporization of the foam material and the molten metal front will progressively move through the gating 5 to the patterns 4. Similarly, as the molten metal front moves into each pattern, the polymeric material of the pattern will melt, vaporize and decompose with the gaseous products of decomposition passing through the porous ceramic coating on the pattern and into the interstices of the surrounding sand. Thus, the molten metal fills the void created by ablation of the pattern to produce a casting identical in configuration to the pattern. In practice, when casting two, six cylinder engine blocks, it requires approximately forty seconds for the molten metal, after being fed into pouring cup 8, to completely fill the casting.

In accordance with the method of the invention, lid 2 of pressure vessel 1 is closed and sealed and pressure is applied through line 9 immediately after the molten metal is poured into cup 8. In practice, the closing of the lid and the application of pressure may occur about four seconds after the molten metal is poured into cup 8, and at this time, the molten metal front is progressing through the gating 5 and may or may not have reached the patterns 4. Thus, with the invention, the external pressure is applied to the molten metal before the molten metal has filled the casting and before the pattern is completely decomposed.

The pressure is maintained until after solidification of the molten metal. By maintaining pressure on the molten metal during filling of the casting, the metal front is more stable and the gaseous products of foam decomposition are less likely to push back the metal front, causing liquid decomposition products to be trapped in the metal. Instead, the gaseous products are pushed to the permeable coating on the pattern and can exit the cavity and condense in the surrounding sand. When pressure is applied to the molten metal after filling of the casting, as in the prior methods, there is a temporary lag in pressure transmittal through the sand, that can result in a sand penetration defect. However, when pressure is applied during pouring, as in the invention, the pressure difference occurs at the metal front not at the coating interface and is eliminated by the time filling of the casting is complete. This is beneficial in eliminating foam defects, such as folds, as well as eliminating metal penetration defects, specific to lost foam casting processes using external pressure.

In order to ensure that the pressure is applied to the molten metal before the pattern is fully decomposed, a means for restricting the flow of molten metal from the pouring cup to the pattern may be utilized. The restricting means may be an object placed into the throat of the sprue in order to restrict the flow of molten metal from the pouring cup to the pattern. In the preferred embodiment, the object is a plug of the metal used to cast the product. Other means may include, but are not limited to, ceramic or other heat resistant plugs, screens, or filters, narrowing of the sprue, or any other contemplated device or method for restricting the flow of molten metal from the pouring cup to the pattern.

The invention has a further advantage, in that it allows for an inexpensive lightweight flask to be used as the mold rather than using a thick walled expensive pressure vessel as the mold, and this constitutes a substantial economic advantage in commercial production. In commercial practice, the number of pressure vessels required for production, depends on the solidification time under pressure that is required to make the production line rate.

While the invention has particular application to lost foam casting, it can also be used in a sand casting process. In sand casting, sand is mixed with about 2% to 3% by weight of a thermosetting resin, such as a phenolic resin, and is then blown and cured in a conventional manner to produce a porous resin-bonded sand mold that defines a closed cavity having the configuration of the article to be cast. The sand mold is positioned in the outer pressure vessel 1, and a large volume pouring cup, similar to cup 8, is placed in the pressure vessel and is connected to the cavity in the sand mold through a sprue/grating system.

As previously described, the molten metal is fed into the pouring cup and the lid on the vessel is closed and pressure of 5 to 50 atmospheres is immediately applied to the molten metal in the cup as well as to the upper surface of the porous sand mold. Thus, the external pressure is applied before the molten metal has completely filled the cavity in the mold.

EXAMPLE

To evaluate the porosity of fold formation defects in 2-cylinder engine blocks, lost foam casting trials using polystyrene patterns were performed with phosphorus refined hypereutectic aluminum silicon alloy 391 containing 19% by weight of silicon and 0.9% by weight of magnesium. The alloy was cast at a temperature of 1400° F. Ten trials were performed with 20 specimens in total. Ten specimens had a pressure of ten atmospheres applied after filling, and ten specimens had ten atmospheres of pressure applied before filling was complete.

To ensure that pressure was applied before filling was complete, a plug of the 391 alloy was inserted into the throat of the sprue. This was done to compensate for the fact that it takes approximately 5 seconds to close the lid of the pressure vessel after pouring is complete, and because it takes another 60 seconds to ramp up the pressure vessel to the appropriate increased pressure.

Table 1, below, demonstrates the comparison between applying pressure after filling is complete and applying pressure before filling is complete for the 2-cylinder engine blocks to determine leakage.

The following demonstrates the results in tabular form:

TABLE 1

2-Cylinder Blocks - Leak Testing Due to Fold Defects

| A) Pressure applied after filling is complete | |
|---|---|
| Trial 1: | 2 blocks of 2 leaked |
| Trial 2: | 2 blocks of 2 leaked |
| Trial 3: | 2 blocks of 2 leaked |
| Trial 4: | 2 blocks of 2 leaked |
| Trial 5: | 2 blocks of 2 leaked |

In summary, part (A) shows that all of the ten engine blocks (100%) demonstrated leakage due to fold defects when pressure was applied after filling of the polymeric foam pattern is complete.

| B) Pressure applied before filling is complete | |
|---|---|
| Trial 6: | 1 block of 2 leaked |
| Trial 7: | 0 blocks of 2 leaked |
| Trial 8: | 0 blocks of 2 leaked |
| Trial 9: | 1 block of 2 leaked |
| Trial 10: | 1 block of 2 leaked |

Contrary to the results listed in part (A) of Table 1, part (B) demonstrates that only 3 of 10, or 30%, of the engine blocks cast demonstrated leakage due to fold defects when pressure is applied before filling of the polymeric foam pattern is substantially complete.

To further evaluate the porosity of foam formation defects, lost foam castings utilizing polystyrene patterns and phosphorous refined hypereutectic aluminum silicon alloy 391 were made for bending fatigue test samples ⅛ inch thick, having a width at the base of 3 inches, and a width at the top tapered end of 1¼ inch and having a length of 6½ inches. Ten trials were prepared in total with ten specimens having a pressure of ten atmospheres applied after filling, and ten specimens having pressure applied before filling was complete.

To ensure that pressure was applied before filling was complete, a plug of the 391 alloy was inserted into the throat of the sprue. This was done to compensate for the fact that it takes approximately 5 seconds to close the lid of the pressure vessel after pouring is complete, and because it takes another 60 seconds to ramp up the pressure vessel to the appropriate increased pressure.

Table 2, below, demonstrates the comparison between applying pressure after filling is complete and applying pressure before filling is complete for the bending fatigue test samples to determine the presence of fold defects.

The following demonstrates the results in tabular form:

TABLE 2

| ⅛ Inch Bending Fatigue Samples - Fold Defects | |
|---|---|
| A) Pressure applied after filling is complete | |
| Trial 1: | 8 of 24 exhibited fold defects |
| Trial 2: | 6 of 24 exhibited fold defects |
| Trial 3: | 8 of 24 exhibited fold defects |
| Trial 4: | 7 of 24 exhibited fold defects |
| Trial 5: | 6 of 24 exhibited fold defects |

In summary, part (A) shows that 35 out of 120 bending fatigue samples cast demonstrated fold defects when pressure was applied after filling of the polymeric foam pattern is complete.

| B) Pressure applied before filling is complete | |
|---|---|
| Trial 6: | 0 of 24 exhibited fold defects |
| Trial 7: | 0 of 24 exhibited fold defects |
| Trial 8: | 0 of 24 exhibited fold defects |
| Trial 9: | 0 of 24 exhibited fold defects |
| Trial 10: | 0 of 24 exhibited fold defects |

In contrast to the results listed in part (A) of Table 1, part (B) demonstrates that none of the 120 bending fatigue samples demonstrated fold defects when pressure was applied before filling of the polymeric foam pattern is substantially complete.

The data clearly demonstrates the beneficial effects of applying pressure before filling is complete to eliminate fold defects in the cast article. The trend of fold defects exhibited in the bending fatigue specimens is significant as the cover of the 2-cylinder engine block has a comparative thickness. The leaks noted in connection with the above engine block tests are primarily due to folds in the cover section, which is the last fill during the casting operation.

As demonstrated when pressure is applied before filling is complete, a significantly less amount of leaks were observed. Similarly, with the bending fatigue specimens, a significantly less amount of fold defects were observed. This reproducible result is directly attributed to the more stable metal front associated with the application of pressure during filling. Such application of pressure decreases the amount of "fingering" in the molten metal front, and in turn reduces folding defects in lost foam casting.

Various modes of carrying out the invention are contemplated as being within the scope of the following claims particularly pointing out and distinctly claiming the subject matter regarded as the invention.

We claim:

1. A method of lost foam casting, comprising the steps of positioning a polymeric foam pattern corresponding in configuration to an article to be cast in a flask, connecting the pattern to a polymeric foam gating system located in the flask, introducing a finely divided inert material in the flask to surround the pattern and the gating system and fill internal cavities in the pattern, placing the flask and the pattern in an outer pressure vessel, positioning a pouring cup in the pressure vessel and connecting said pouring cup with said gating system, pouring a molten metal into the pouring cup, the heat of said molten metal acting to decompose the gating system and pattern with the molten metal filling the void created by decomposition of the polymeric foam material and the products of decomposition passing into the interstices of the finely divided material, sealing the pressure vessel with the pouring cup retained within said vessel, applying an external pressure in the range of 5 to 60 atmospheres to the molten metal in the pouring cup and to the finely divided material in the flask after sealing the vessel and before the molten metal has fully decomposed the pattern, maintaining said pressure on said molten metal until said molten metal fully decomposes the pattern, and continuing said pressure during solidification of said molten metal to produce a cast article corresponding in configuration to the pattern.

2. The method of claim 1, wherein said molten metal is selected from the group consisting of an aluminum alloy, a magnesium alloy, cast iron and a stainless steel alloy.

3. The method of claim 1, wherein said pattern comprises a component of an internal combustion engine.

4. The method of claim 1, where in the pouring cup has a volume equal to 15% to 75% of the combined volume of the gating system and said pattern.

5. The method of claim 1, wherein th e flask is composed of metal and the pouring cup is composed of ceramic material.

6. The method of claim 1, and including the step of restricting the flow of molten metal from the pouring cup to the pattern to ensure that said pressure is applied to the molten metal before the pattern is fully decomposed.

7. An apparatus for lost foam casting of metal articles, comprising a pressure vessel having a removable lid, a flask removably contained and sealed within the pressure vessel, a polymeric foam pattern corresponding in configuration to an article to be cast and disposed in the flask, a finely divided inert material disposed in the flask and surrounding the pattern and filling voids in the pattern, a pouring cup, having a volume equal to 15% to 75% of the combined volume of a gating system and the pattern, disposed in the pressure vessel within the lid, said polymeric foam gating system connecting the pouring cup with the pattern, a molten metal contained in the cup, the heat of the molten metal acting to ablate the gating system and pattern with the molten metal filling the void created by ablation of the gating system and pattern and the products of decomposition being trapped in the interstices of the finely divided material, a means for applying pressure to the molten metal in the pouring cup and to said inert material in the flask before filling of the void with said molten metal is complete, and a means for restricting the flow of molten metal from the pouring cup to the pattern to ensure that the pressure is applied to the molten metal before the pattern is fully decomposed.

* * * * *